US009061541B2

(12) United States Patent
Elmore

(10) Patent No.: US 9,061,541 B2
(45) Date of Patent: Jun. 23, 2015

(54) SELF-RETAINING WRITING INSTRUMENT

(71) Applicant: James Michael Elmore, Atlanta, GA (US)

(72) Inventor: James Michael Elmore, Atlanta, GA (US)

( * ) Notice: Subject to any disclaimer, the term of this patent is extended or adjusted under 35 U.S.C. 154(b) by 92 days.

(21) Appl. No.: 13/856,914

(22) Filed: Apr. 4, 2013

(65) Prior Publication Data

US 2013/0266360 A1 Oct. 10, 2013

Related U.S. Application Data

(60) Provisional application No. 61/620,394, filed on Apr. 4, 2012.

(51) Int. Cl.

| | |
|---|---|
| ***B43K 23/00*** | (2006.01) |
| ***B43K 8/00*** | (2006.01) |
| ***B43K 8/02*** | (2006.01) |
| ***B43K 23/08*** | (2006.01) |
| ***B43K 23/12*** | (2006.01) |
| ***B43K 7/00*** | (2006.01) |

(52) U.S. Cl.

CPC ..... *B43K 23/001* (2013.01); *B43K 8/003* (2013.01); *B43K 8/02* (2013.01); *B43K 23/08* (2013.01); *B43K 23/12* (2013.01); *B43K 7/005* (2013.01)

(58) Field of Classification Search

CPC ..... B43K 23/001; B43K 23/002; B43K 5/16; B43K 7/12

USPC ..... 401/6, 8, 52, 195

See application file for complete search history.

(56) References Cited

U.S. PATENT DOCUMENTS

| | | | | |
|---|---|---|---|---|
| 2,266,942 | A * | 12/1941 | Wallace | 63/1.12 |
| 4,162,754 | A * | 7/1979 | Fleming | 224/165 |
| 5,584,195 | A * | 12/1996 | Liu | 63/1.12 |
| 6,474,892 | B2 * | 11/2002 | Chao | 401/195 |
| 2003/0155389 | A1 * | 8/2003 | Swartzentruber | 224/164 |
| 2009/0202287 | A1 * | 8/2009 | Katsanevas | 401/131 |
| 2010/0258601 | A1 * | 10/2010 | Thrope | 224/267 |
| 2011/0236120 | A1 * | 9/2011 | Rolion et al. | 401/99 |
| 2012/0214380 | A1 * | 8/2012 | Vine, III | 446/121 |
| 2013/0044215 | A1 * | 2/2013 | Rothkopf et al. | 348/143 |
| 2014/0035884 | A1 * | 2/2014 | Oh et al. | 345/179 |

FOREIGN PATENT DOCUMENTS

| | | | |
|---|---|---|---|
| DE | 202009012031 | U1 | 12/2009 |
| DE | 202009014831 | U1 | 2/2010 |
| DE | 102010036953 | A1 | 1/2012 |

OTHER PUBLICATIONS

Form PCT/ISA/206, Invitation to Pay Additional Fees and Communication Relating to the Results of the Partial International Search for PCT/US2013/035279, mailed Jun. 19, 2013.

* cited by examiner

*Primary Examiner* — David Walczak
*Assistant Examiner* — Joshua Wiljanen
(74) *Attorney, Agent, or Firm* — Sutherland Asbill & Brennan LLP

(57) ABSTRACT

Self-retaining writing instruments include a bistable metal body that is selectively positionable and retainable in a coiled configuration and alternatively in an elongated configuration, and a writing element, such as a pencil, pen, marker, or stylus, disposed at a first end of the writing instrument. The coiled configuration may be suitable for coiling around an object and the elongated configuration may be suitable for use as a writing instrument. The bistable metal body may be configured to automatically assume the coiled configuration when flexed to a certain degree while in the elongated configuration.

20 Claims, 8 Drawing Sheets

SELF-RETAINING WRITING INSTRUMENT

CROSS-REFERENCE TO RELATED APPLICATIONS

The present application claims priority benefit of U.S. Provisional Application No. 61/620,394, filed Apr. 4, 2012, which is incorporated herein by reference.

FIELD

The present disclosure relates generally to writing instruments, and more specifically to self-retaining writing instruments.

BACKGROUND

Writing instruments, such as pens, pencils, and styluses, are used by millions of people every day. Not infrequently, and despite efforts and various methods for securing them, writing instruments are misplaced and/or not readily available when or where they are needed.

Current techniques to secure writing instruments to oneself or to certain objects for use when needed are not sufficient in many instances. For example, some writing instruments include a clip for being secured to a pocket or to the thin edge of another object, such as a clipboard, folder, or book cover. In many instances, no such object exists and therefore keeping the writing instrument secure and readily available is a challenge.

Some writing instruments have tethers allowing the instrument to be secured around a user's neck or other body part or object. In many instances, this also may not be ideal. The cord tether method may be ergonomically or aesthetically undesirable, or even dangerous.

Adhesive materials, such as VELCRO® (i.e., hook and loop material) or chemical adhesives, have also been used to secure writing instruments. These techniques are suitable in some scenarios but not ideal for many others. For example, the opposing side of the hook and loop material may not be present on, or the adhesive will not adhere to, the object to which a user may wish to secure the writing instrument. Moreover, VELCRO® and other adhesives tend to become less adherent over time as the loop material is torn or the adhesive is exhausted.

Accordingly, there is a need for improved securable writing instruments.

SUMMARY

In one aspect, a securable, self-retaining writing instrument is provided, including a bistable metal body that is selectively positionable and retainable in a coiled configuration and alternatively in an elongated configuration, and a writing element disposed at the first end of the writing instrument. In certain embodiments, the writing element is a pencil, pen, marker, or stylus. In certain embodiments, the bistable metal body is configured to automatically assume the coiled configuration when flexed to a certain degree in the elongated configuration.

In another aspect, a self-retaining writing instrument includes a bistable metal body configured to automatically assume the coiled configuration around a user's wrist when pushed against the wrist in the elongated configuration, a plastic cover surrounding the bistable metal body, and a writing element fixedly disposed at a first end of the writing instrument.

In another aspect, a self-retaining writing instrument includes a bistable metal body that is selectively positionable and retainable in a coiled configuration for coiling around an object and alternatively in an elongated configuration for use as a writing instrument, a plastic cover surrounding the bistable metal body, a ballpoint pen disposed in a first end of the plastic cover, and an ink reservoir disposed in the first end of the plastic cover and in fluid communication with the ballpoint pen.

DETAILED DESCRIPTION

The present disclosure will now be described more fully hereinafter with reference to the accompanying drawings, in which several embodiments of self-retaining writing instruments are shown. Like numbers refer to like elements throughout the drawings.

The present disclosure addresses the above-described needs by providing securable, self-retaining writing instruments. Several embodiments of self-retaining writing instruments are described below, although the embodiments described herein may also be used with other materials or designs. Parameters of different components and designs of the embodiments are described separately, but may be combined consistently with this description and claims to enable still other embodiments as will be understood by those skilled in the art.

Figure 1:
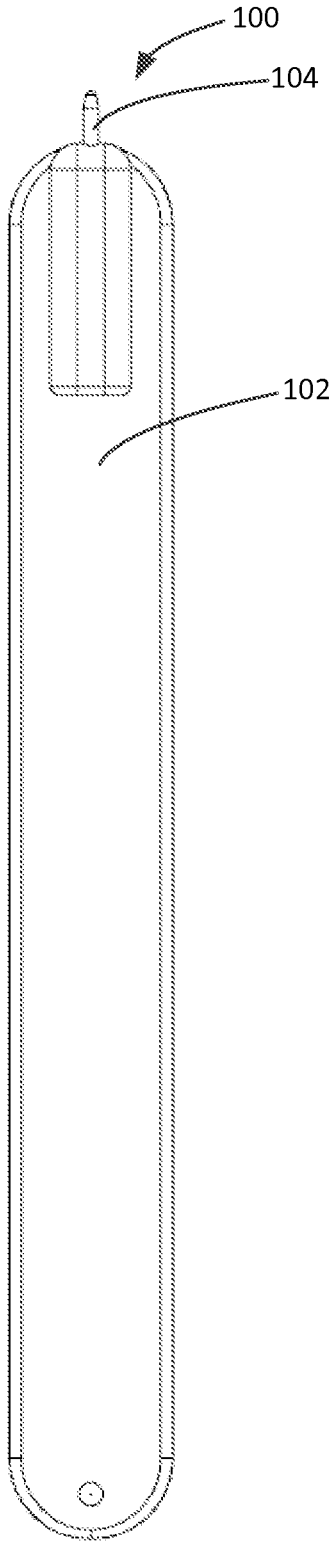
FIG. 1 is a perspective front view, showing a self-retaining writing instrument in an elongated configuration.

In certain embodiments, as shown in FIG. 1, a self-retaining writing instrument 100 includes a bistable metal body 102 selectively positionable and retainable in a coiled configuration and alternatively in an elongated configuration, and a writing element 104 disposed at the first end of the writing instrument.

Figure 7:
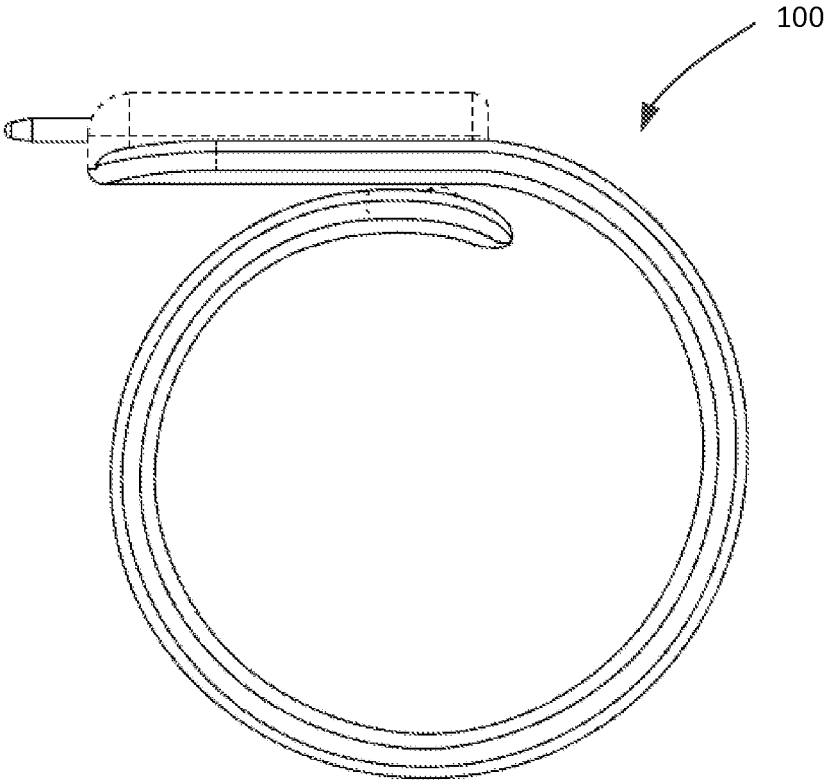
FIG. 7 is an upper perspective view, showing a self-retaining writing instrument in a coiled configuration.

As used herein, the term "self-retaining" refers to the writing instrument being configured to secure itself in place on or around an object. For example, the writing instrument may be configured to secure itself on the wrist, ankle, or leg of a user, a steering wheel, a musical instrument, a mug or other cup, a bag or purse strap, or a furniture leg or post. As used herein, the term "bistable" refers to the metal body having two physical configurations (i.e., elongated and coiled), or positions, in which the body is stable. For example, the metal body may remain in the elongated configuration until flexed to a certain degree at which time the metal body may assume the coiled configuration until it is uncoiled by a user. As used herein, the term "elongated configuration" refers to the writing instrument 100 having a straightened, or lengthened, shape that may be suitable for use as a writing instrument, such as shown in FIG. 1. As used herein, the term "coiled configuration" refers to the writing instrument 100 having a curled, or looped, shape that may be suitable for securing the instrument on an object, as shown in FIG. 7.

The bistable metal body may include any metal material that may be configured to have the necessary bistable properties. For example, the metal body may include a flexible metal material. The bistable metal body may be thin and elongated, i.e., have a length that is relatively long as compared to its width. For example, to fabricate the bistable metal body, a flexible metal material can be fashioned into a thin, elongated strip, and coiled. The metal material may then be bent along a longitudinal axis such that it remains elongated when straightened or uncoiled, and springs into a coil when flexed to a certain degree.

Figure 6:
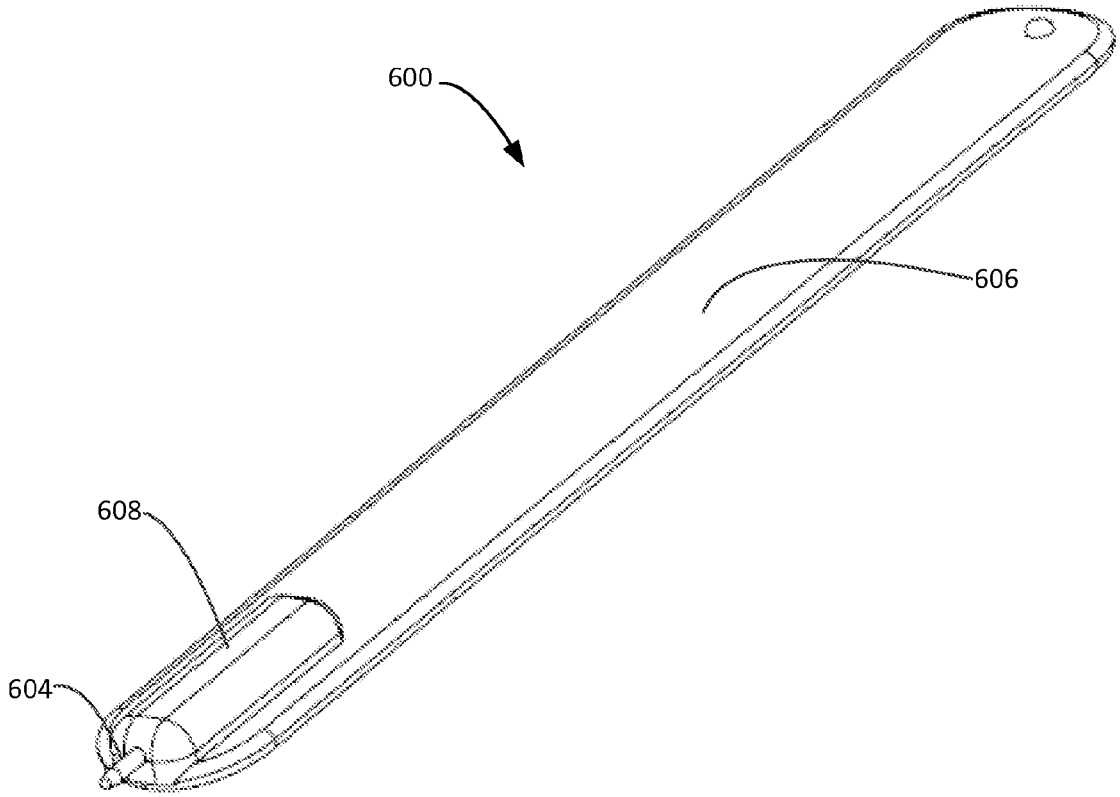
FIG. 6 is an upper perspective view, showing a self-retaining writing instrument in an elongated configuration.

In certain embodiments, as shown in FIG. 6, a plastic or fabric cover 606 surrounds the bistable metal body. For example, a soft plastic or rubber cover may surround the bistable metal body. The cover may be sized and shaped to allow the bistable metal body to maintain its bistable, or spring, properties. The cover may serve to protect the user from any sharp or blunt edges of the metal body. The cover may also include one or more projections or textured areas that provide a grippable surface and/or an interlocking feature for use in the coiled configuration.

As shown in FIG. 1, the writing element 104 is disposed at one end of the writing instrument 100, for example, at one end of the elongated metal body or its cover. The writing element may be a pencil, such as a mechanical pencil, a pen, such as a ballpoint pen, a marker, such as a felt tip marker, a stylus, or another instrument. The writing element may also be a flash drive or light. The writing element may be built into, or attached to, the end of the metal body or its cover. The writing instrument may include a removable cap that is sized and shaped to fit on the end of the writing element. For example, the cap may be unattached or attached (e.g., via a cord or tether) to the writing instrument.

Figure 2:
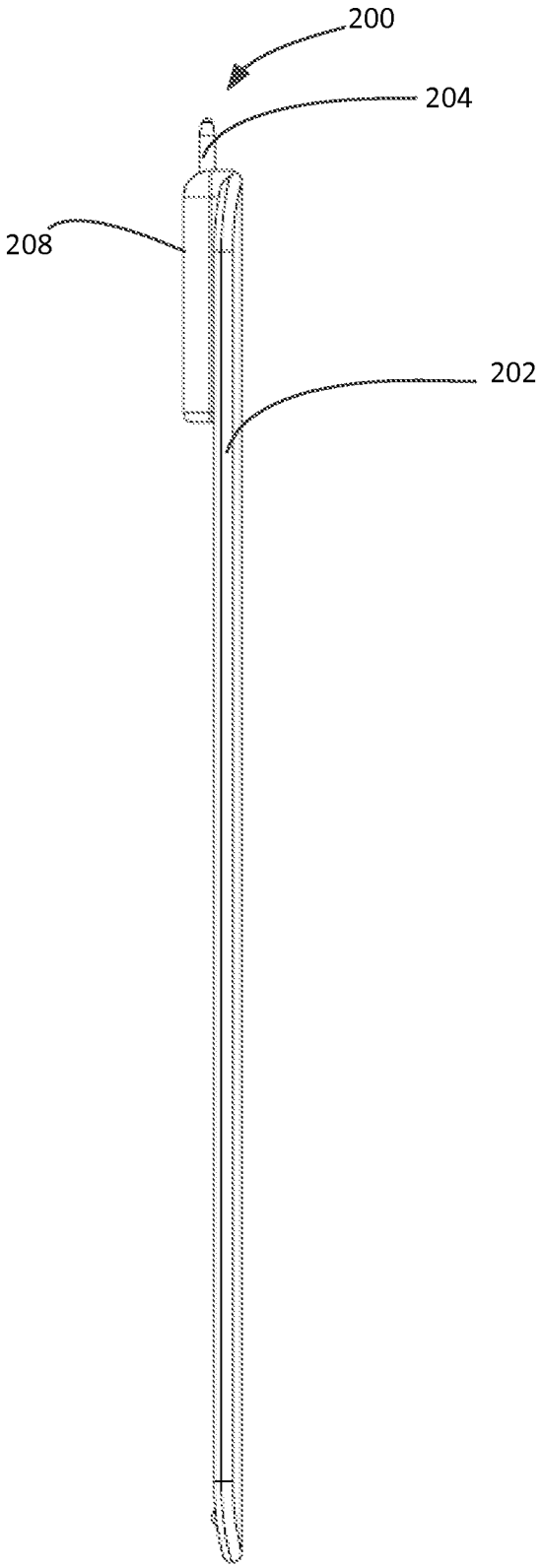
FIG. 2 is a perspective side view, showing a self-retaining writing instrument in an elongated configuration.
Figure 3:
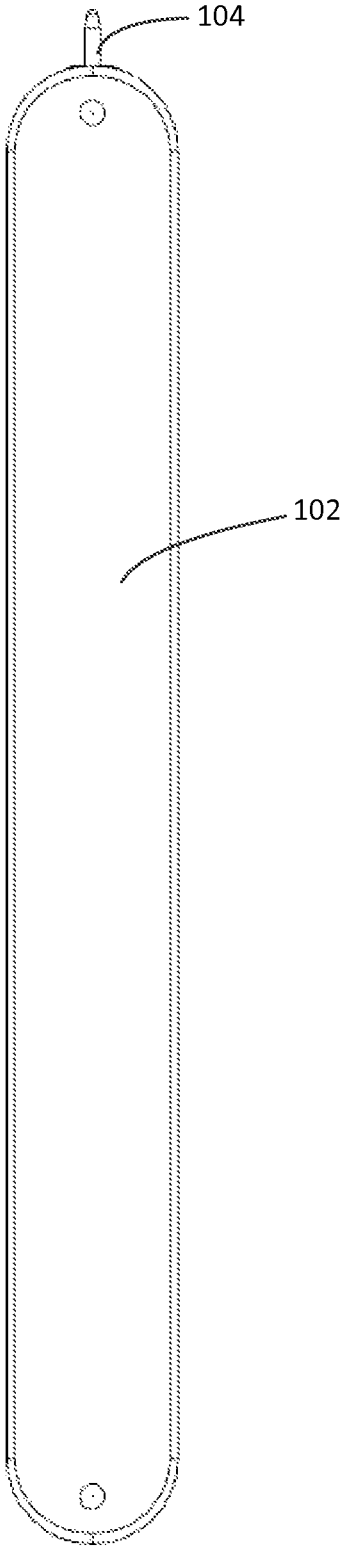
FIG. 3 is a perspective rear view, showing a self-retaining writing instrument in an elongated configuration.
Figure 4:
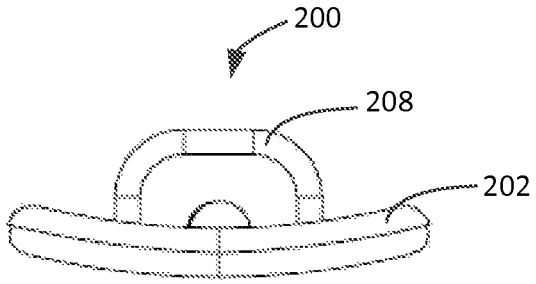
FIG. 4 is a perspective bottom view, showing the second end of a self-retaining writing instrument.
Figure 5:
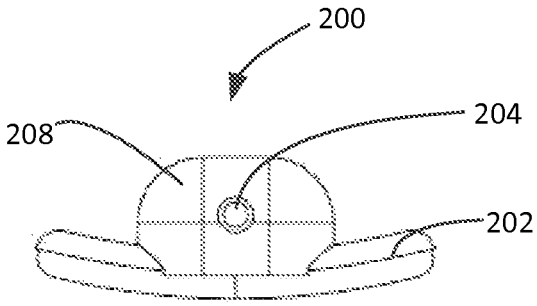
FIG. 5 is a perspective top view, showing the first end of a self-retaining writing instrument.

In certain embodiments, as shown in FIG. 2, the writing instrument 200 includes a reservoir 208 for ink or lead. The reservoir may be contained within a recess or housing, for example where the reservoir and/or writing element are retractable. As shown in FIGS. 2, 4, and 5, the reservoir 208 may be located at or near the first end of the writing instrument 200 (i.e., where the writing element 204 is disposed). For example, where the writing element 204 is a pen, the reservoir 208 may contain ink and be in fluid communication with the writing element 204. Some portion of the writing element and/or reservoir may be covered with the same material as the metal body. As shown in FIGS. 1 and 3, the writing element 104 may be disposed on one side of the elongated metal body 102, such that a rear side of the metal body is substantially smooth.

In certain embodiments, as shown in FIG. 6, the writing element 604 is fixedly disposed at the first end of the writing instrument 600. The reservoir 608 may also be fixed in place at or near the first end of the writing instrument 600.

In certain embodiments, the writing element is retractably disposed at the first end of the writing instrument. For example, the writing element may be recessed within or attached at the end of the writing instrument such that it can be extended and retracted. In one embodiment, the writing element is a pen and the writing instrument includes an ink reservoir, and the pen and/or ink reservoir are selectively movable between an extended locked position and a retracted locked position. A locking slide lever, hinge, or other actuating mechanism may be used to move between the extended and retracted positions.

Figure 8A:
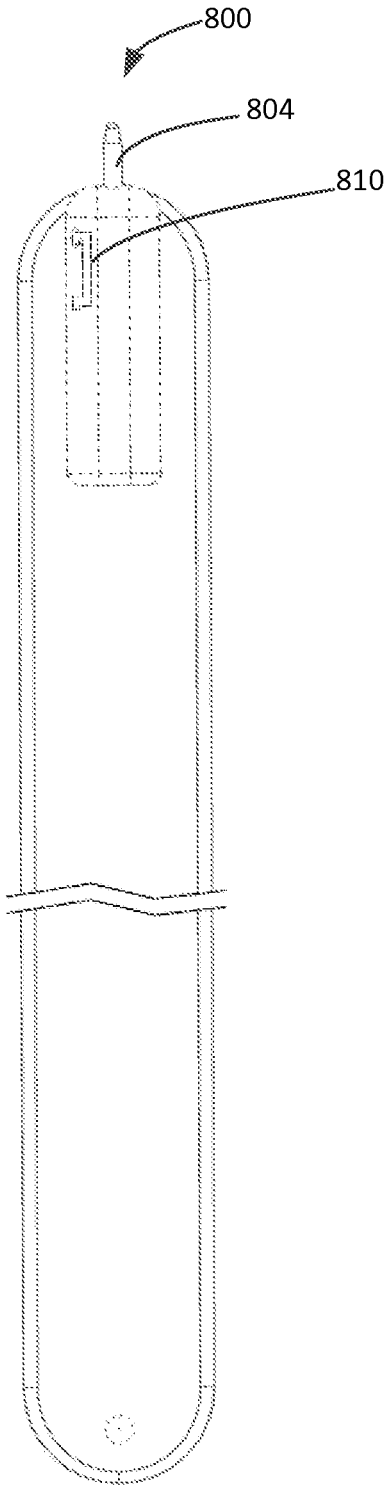
FIG. 8A is a perspective front view, showing a self-retaining writing instrument having a sliding retractable writing element.
Figure 8B:
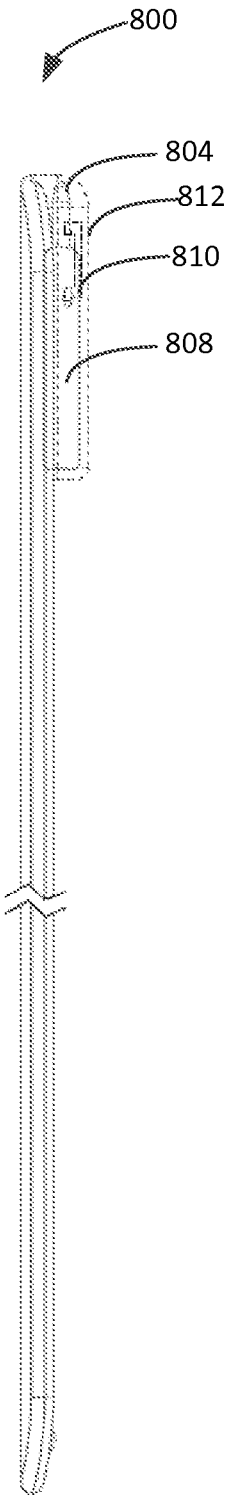
FIG. 8B is a perspective side view, showing the self-retaining writing instrument of FIG. 8A.

As shown in FIGS. 8A and 8B, a slide lever mechanism 810 may be exposed on one side of the writing instrument 800, for example at or near the first end of the writing instrument 800. The slide lever 810 may be configured to slide between a first locked position extending the writing element 804, as shown in FIG. 8A, and a second locked position retracting the writing element 804, as shown in FIG. 8B. The second locked position may include retracting the writing element 804 within a recess 812 in the first end of the writing instrument. For example, the recess 812 may contain a reservoir 808 and be sized such that the reservoir 808 and writing element 804 can both slide therein between the first and second locked positions. In the second locked position, both the writing element 804 and reservoir 808 are protected within the recess 812. For example, the retracted locked position may include the writing being recessed within the plastic cover that covers the metal body, writing element, and/or reservoir.

Figure 9A:
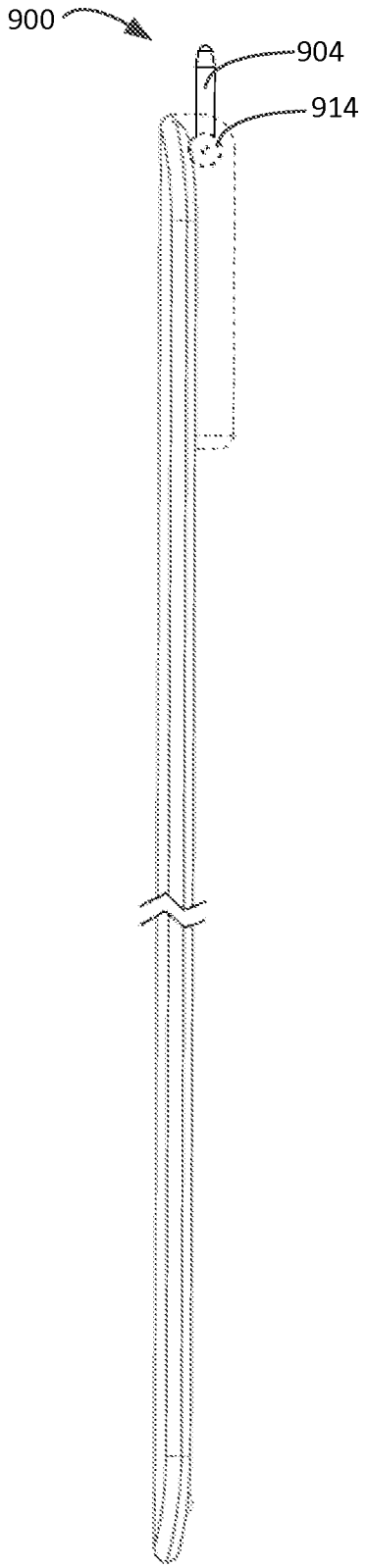
FIG. 9A is a perspective side view, showing a self-retaining writing instrument having a hinged retractable writing element.
Figure 9B:
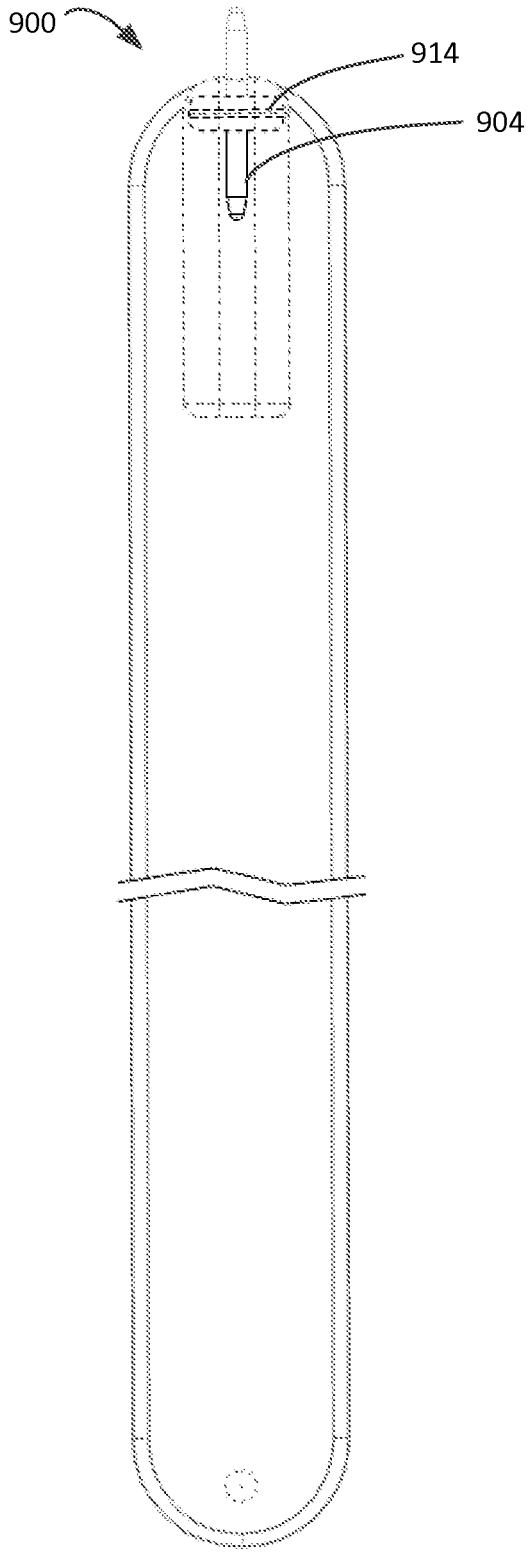
FIG. 9B is a perspective front view, showing the self-retaining writing instrument of FIG. 9A.

As shown in FIGS. 9A and 9B, the writing element 904 may be retractably disposed at the first end of the writing instrument 900 via a hinge 914 that is configured to lock the writing element 904 in place when the writing element 904 is extended or folded. For example, the writing element may simply fold inward to a position adjacent the metal body or reservoir, or the writing element may fold into a recess.

Figure 10A:
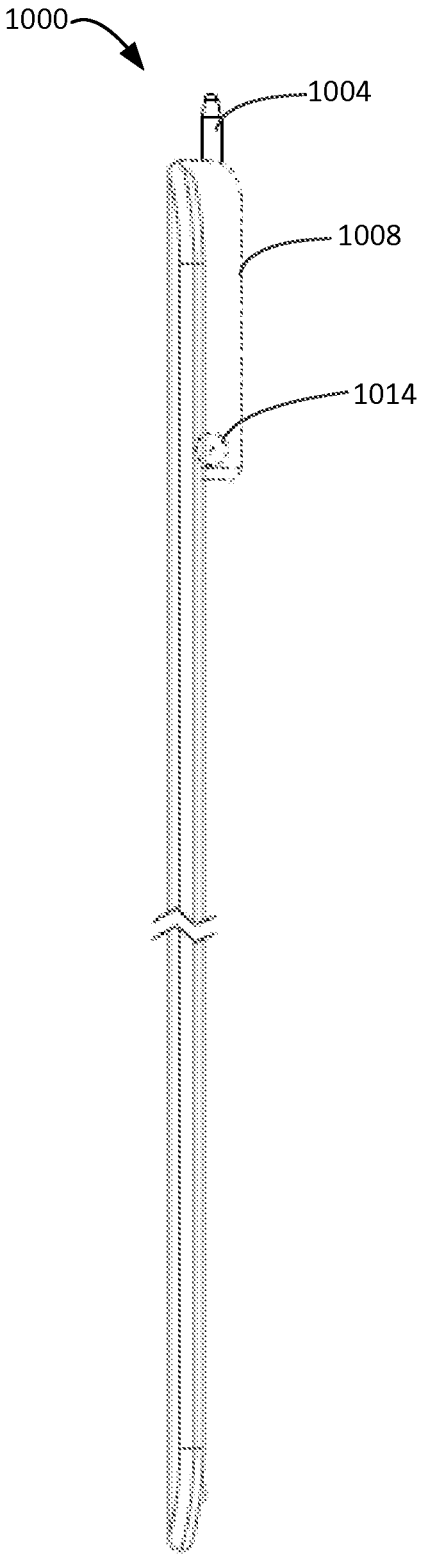
FIG. 10A is a perspective side view, showing a self-retaining writing instrument having a hinged retractable writing element.
Figure 10B:
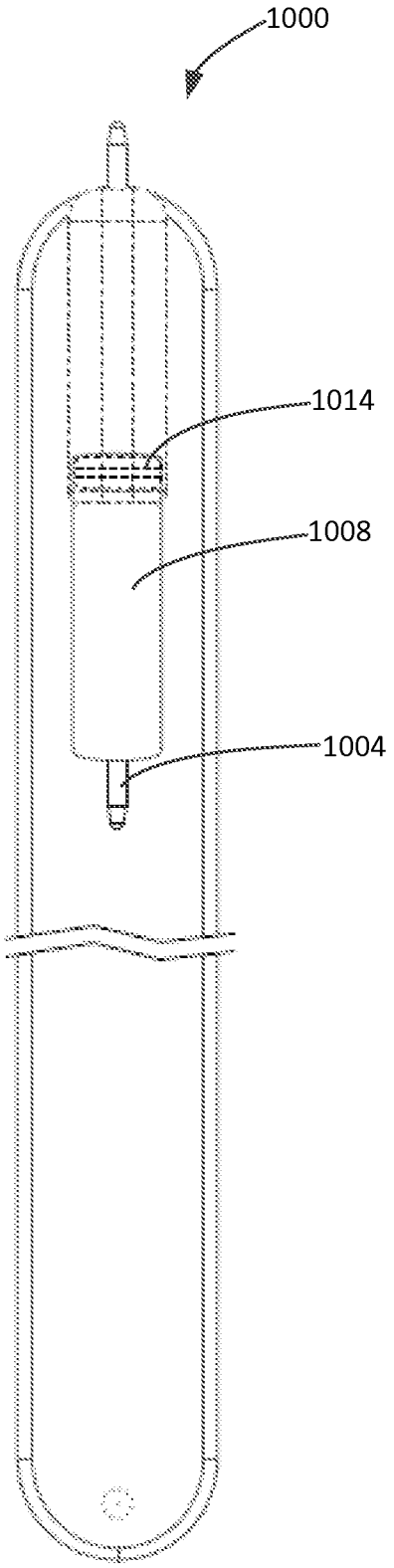
FIG. 10B is a perspective front view, showing the self-retaining writing instrument of FIG. 10A.

As shown in FIGS. 10A and 10B, the hinge 1014 may be configured to move a ballpoint pen writing element 1004 and ink reservoir 1008 between an extended locked position, as shown in FIG. 10A, and a retracted locked position, as shown in FIG. 10B.

Figure 11:
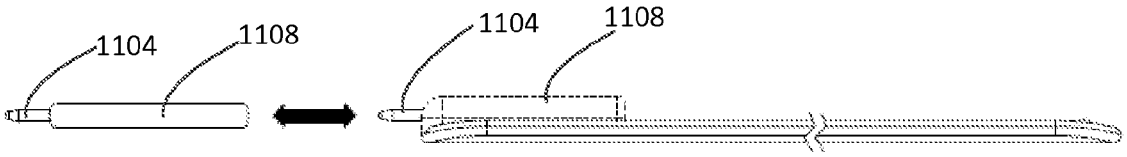
FIG. 11 is a perspective side view, showing a self-retaining writing instrument having a replaceable writing element.

As shown in FIG. 11, the writing element 1104 and/or reservoir 1108 may be replaceable. For example, the writing element and reservoir may be a in the form of a cartridge that is able to be removed by the user and replaced with a new cartridge. For example, the cartridge may snap or slide into a locked position.

In one embodiment, as shown in FIG. 6, the self-retaining writing instrument 600 includes a bistable metal body that is selectively positionable and retainable in a coiled configuration and alternatively in an elongated configuration, a plastic cover 606 surrounding the bistable metal body, and a writing element 604 fixedly disposed at a first end of the writing instrument 600. The writing element 604 may be a ballpoint pen that is disposed in the first end of the plastic cover 606. An ink reservoir 608 may also be disposed in the first end of the plastic cover 606 and in fluid communication with the ballpoint pen 604.

In certain embodiments, the writing instrument is decorated in such a way as to double as an ornament, bracelet, or other fashion accessory. For example, the writing instrument may include a plastic or fabric cover having a color or design thereon. In certain embodiments, the writing instrument may include text printed thereon, such as a logo, instructions for use, or ruler markings.

In certain embodiments, the bistable metal body is configured to spring from the elongated configuration to the coiled configuration when pushed against an object. That is, the bistable metal body may be secured around an object by slapping or pushing the metal body in the straight, elongated state against the object, thereby causing the body to spring into coil, and conform to the object. For example, the object may be a wrist or ankle, a bag strap, a steering wheel, or a furniture leg or post. When pushed against the object, the bistable metal body may automatically coil around and conform to the object. For example, the bistable metal body may coil around and conform to a user's wrist when pressed thereagainst. This coiled configuration provides a secured, self-retained writing instrument. For example, a user may coil the writing instrument around his/her wrist to provide hands-free retention of the writing instrument.

The bistable metal body may automatically assume the coiled configuration when flexed to a certain degree in the elongated configuration. When writing is desired, the instrument may be straightened for use. These writing instruments advantageously allow the securing of the writing instrument to oneself or to any number of objects so that it may be readily available for use when and where needed.

Moreover, these self-retaining writing instruments allow for the securing of the writing instrument to a multitude of objects not possible or practical with current methods. The self-retaining instruments allow a user to secure the writing instrument with one hand, and without the need for visual input, exposed edges, or special materials. With any of the previous methods for securing a writing device, re-securing the writing device after use may also be more cumbersome than with the present self-retaining instruments.

It will be appreciated that various of the above-disclosed and other features and functions, or alternatives thereof, may be desirably combined into many other different designs, products, or applications. Various presently unforeseen or unanticipated alternatives, modifications, variations, or improvements thereto may be subsequently made by those skilled in the art, which are also intended to be encompassed by the following claims.

What is claimed is:

1. A self-retaining writing instrument comprising:

a bistable metal body that is selectively positionable and retainable in a coiled configuration and alternatively in an elongated configuration; and a writing element disposed at a first end of the writing instrument.

2. The self-retaining writing instrument of claim 1, wherein the bistable metal body is configured to automatically assume the coiled configuration when flexed to a certain degree in the elongated configuration.

3. The self-retaining writing instrument of claim 1, wherein the writing element is a pencil, pen, marker, or stylus.

4. The self-retaining writing instrument of claim 1, wherein the writing element is fixedly disposed at the first end of the writing instrument.

5. The self-retaining writing instrument of claim 1, wherein the writing element is retractably disposed at the first end of the writing instrument.

6. The self-retaining writing instrument of claim 5, wherein the writing element is retractably disposed at the first end via a hinge that is configured to lock the writing element in place when the writing element is extended or folded.

7. The self-retaining writing instrument of claim 5, further comprising a slide lever that is exposed at or near the first end of the writing instrument, the slide lever being configured to slide between a first locked position extending the writing element and a second locked position retracting the writing element.

8. The self-retaining writing instrument of claim 7, wherein the second locked position comprises retracting the writing element within a recess in the first end of the writing instrument.

9. The self-retaining writing instrument of claim 1, further comprising a plastic or fabric cover surrounding the bistable metal body.

10. The self-retaining writing instrument of claim 1, further comprising an ink reservoir at or near the first end of the writing instrument, wherein the writing element is an ink pen in fluid communication with the ink reservoir.

11. The self-retaining writing instrument of claim 1, wherein the bistable metal body is configured to automatically coil around and conform to an object when pushed thereagainst in the elongated configuration.

12. The self-retaining writing instrument of claim 11, wherein the object is a wrist, a bag strap, a steering wheel, or a furniture leg.

13. A self-retaining writing instrument, comprising:

a bistable metal body that is selectively positionable and retainable in a coiled configuration and alternatively in an elongated configuration;

a plastic cover surrounding the bistable metal body; and a writing element fixedly disposed at a first end of the writing instrument, wherein the bistable metal body is configured to automatically assume the coiled configuration around a user's wrist when pushed against the wrist in the elongated configuration.

14. The self-retaining writing instrument of claim 13, wherein the writing element is a pencil, pen, marker, or stylus.

15. A self-retaining writing instrument comprising:

a bistable metal body that is selectively positionable and retainable in a coiled configuration for coiling around an object and alternatively in an elongated configuration for use as a writing instrument;

a plastic cover surrounding the bistable metal body;

a ballpoint pen disposed in a first end of the plastic cover; and an ink reservoir disposed in the first end of the plastic cover and in fluid communication with the ballpoint pen.

16. The self-retaining writing instrument of claim 15, wherein the ballpoint pen and/or ink reservoir is selectively movable between an extended locked position and a retracted locked position.

17. The self-retaining writing instrument of claim 16, further comprising a hinge configured to move the ballpoint pen and/or ink reservoir between the extended locked position and the retracted locked position.

18. The self-retaining writing instrument of claim 16, further comprising a slide lever configured to move the ballpoint pen and/or ink reservoir between the extended locked position and the retracted locked position.

19. The self-retaining writing instrument of claim 18, wherein the retracted locked position comprises the ballpoint pen being recessed within the plastic cover.

20. The self-retaining writing instrument of claim 15, wherein the bistable metal body is configured to spring from the elongated configuration to the coiled configuration when pushed against the object.

* * * * *